US009488016B2

(12) United States Patent
Gubbins et al.

(10) Patent No.: US 9,488,016 B2
(45) Date of Patent: Nov. 8, 2016

(54) SPHERICAL BALL SKATE FOR CONTINUOUS WELL STRING INJECTORS

(71) Applicant: Celtic Machining Ltd., Rainier (CA)

(72) Inventors: Martin E. C. Gubbins, Rainier (CA); Sven W. Larsen, Rainier (CA)

(73) Assignee: CELTIC MACHINING LTD., Rainier, Alberta (CA)

( * ) Notice: Subject to any disclaimer, the term of this patent is extended or adjusted under 35 U.S.C. 154(b) by 0 days.

(21) Appl. No.: 14/787,407

(22) PCT Filed: May 2, 2014

(86) PCT No.: PCT/CA2014/050421

§ 371 (c)(1),
(2) Date: Oct. 27, 2015

(87) PCT Pub. No.: WO2014/176702

PCT Pub. Date: Nov. 6, 2014

(65) Prior Publication Data

US 2016/0069143 A1 Mar. 10, 2016

Related U.S. Application Data

(60) Provisional application No. 61/819,178, filed on May 3, 2013.

(51) Int. Cl.

| | |
|---|---|
| ***E21B 19/08*** | (2006.01) |
| ***E21B 19/22*** | (2006.01) |
| ***B66D 3/00*** | (2006.01) |

(52) U.S. Cl.
CPC ..... *E21B 19/08* (2013.01); *B66D 3/003* (2013.01); *E21B 19/22* (2013.01)

(58) Field of Classification Search
CPC ..... E21B 19/08; E21B 19/22; B66D 3/003
See application file for complete search history.

(56) References Cited

U.S. PATENT DOCUMENTS

| | | | | |
|---|---|---|---|---|
| 3,945,514 | A | 3/1976 | Dose | |
| 4,075,917 | A * | 2/1978 | Kistner | B26D 1/147 83/422 |
| 5,918,671 | A | 7/1999 | Bridges et al. | |
| 6,173,769 | B1 | 1/2001 | Goode | |

* cited by examiner

*Primary Examiner* — David Andrews
(74) *Attorney, Agent, or Firm* — Kyle R. Satterthwaite; Ryan W. Dupuis; Ade & Company Inc.

(57) ABSTRACT

A skate for an injector apparatus in which gripper dies on a pair of endless chains driven around respective closed loop paths on different sides a continuous wellbore string are forced against the continuous string by forcing a set of the skates toward theretoward from inside the closed loop paths of the endless chains. The inventive skate features a skate body carrying a plurality of spherical balls that are exposed on a side of the skate that faces toward the continuous string in order to allow riding of endless chains over exposed surfaces of the spherical balls as the endless chains are driven through the respective closed-loop paths, whereby the gripper dies ride over the spherical balls of said skates under the forcing of said skates toward the continuous string.

19 Claims, 8 Drawing Sheets

FIG. 2B
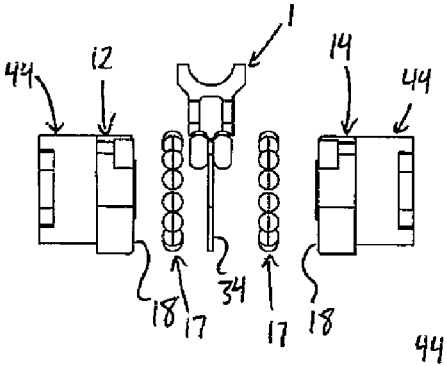
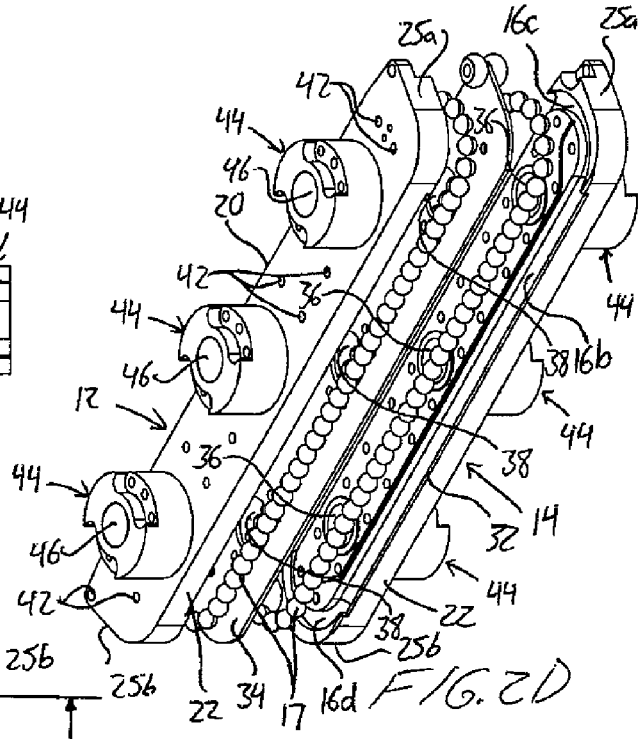
FIG. 2D
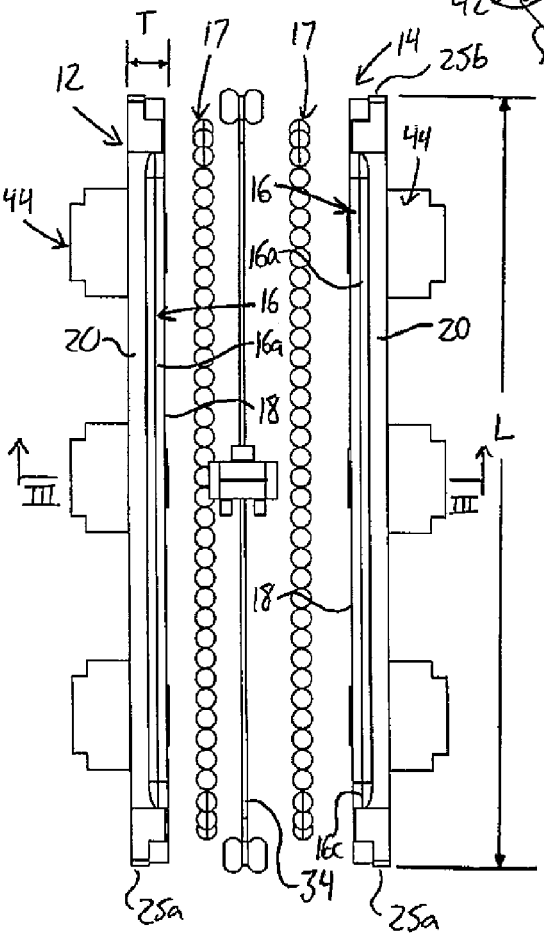
FIG. 2A
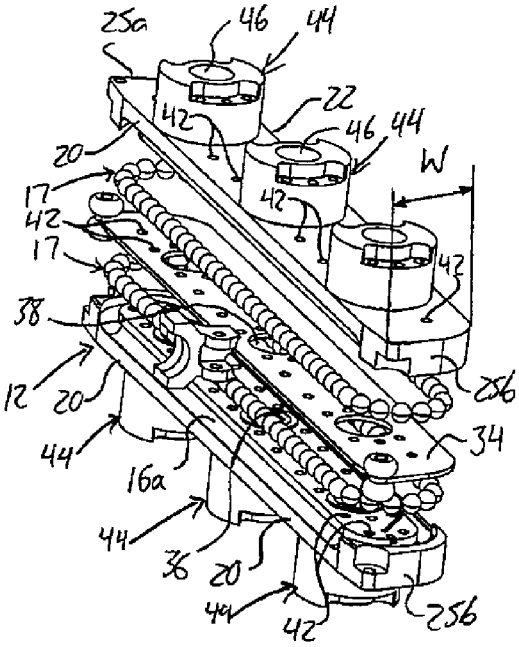
FIG. 2C

SPHERICAL BALL SKATE FOR CONTINUOUS WELL STRING INJECTORS

This application is the national stage of PCT/CA2014/050421, filed May 2, 2014, and claims benefit under 35 U.S.C. 119(e) of U.S. Provisional Application Ser. No. 61/819,1178, filed May 3, 2013.

FIELD OF THE INVENTION

The present invention relates generally to well string injectors used to inject continuous rod or tubing string into a wellbore by gripping the string between gripping dies on counter-rotating conveyor chains, and more particularly to an injector that uses spherical-ball rolling elements instead of conventional cylindrical rollers on the skates that force the gripping dies together as the chains move between the skates at facing together sides thereof on opposing sides of the string.

BACKGROUND OF THE INVENTION

Coiled tubing is commonly used in the oilfield industry, and it is also becoming more common to employ continuous coiled rod instead of conventional sucker rod, for example for the purpose of driving downhole pump equipment, thereby avoiding the need to thread together discrete rod sections via threaded couplers at the ends thereof.

Injectors for coiled tubing or continuous rod typically employ a pair of endless chains driven in counter-rotating directions in a common upright plane, and carrying gripper dies or blocks on the chains that have outward facing gripping surfaces to clench the continuous rod between the faces of opposed gripper dies on the two chains as they descend downward on adjacent, facing-together, parallel sides of the two chain paths. A respective skate is found inside the area around which each chain is driven in order to lie along this descending side of the chain, and the skates are displaceable toward one another by hydraulic cylinders, thereby forcing the descending gripper blocks toward one another to firmly grip the coil tubing or continuous rod between them.

Prior art in the general area of injector heads and gripper dies for same includes U.S. Pat. Nos. 5,094,340, 5,553,668, 5,918,671, 6,425,441, U.S. Pat. Nos. 6,516,891, 6,609,566, 6,880,629, 6,892,810, 7,051,814, 7,857,042 and 8,132,617, and U.S. Patent Application Publication 2012/0222855.

Skates for injector heads have typically employed cylindrical rollers to apply force against the bases of the gripper dies, either by rotatably supporting rollers at fixed locations along the side of the skate body or by using roller chain that is entrained around the skate body.

However, Applicant has developed a unique skate design employing spherical balls instead of cylindrical rollers as the roller elements over which the gripper dies move as they are forced together by the skates.

SUMMARY OF THE INVENTION

According to a first aspect of the invention there is provided an apparatus for injecting or withdrawing a continuous string into and from a wellbore, the apparatus comprising:

a plurality of endless drive conveyors positioned on different respective sides of an upright pathway in which an upright length of the continuous string is receivable, each endless drive conveyor comprising an endless chain and a plurality of gripper dies coupled to the endless chain, each gripping die having a gripping face that faces outwardly from the endless chain and is shaped to engage a periphery of the continuous string and a base surface that faces inwardly from the endless chain, the endless chains being arranged for driven movement around respective closed-loop paths on the different sides of the upright pathway such that the gripper dies of each endless chain are conveyed in a same direction along the upright pathway at the respective side thereof during a portion of the respective closed-loop path;

a plurality of skates respectively residing on the different respective sides of the pathway with the closed-loop path of each endless chain closing around a respective one of the skates, each skate carrying a plurality of spherical balls that are exposed on a side of the skate that faces toward the pathway; and a force application mechanism operable to force the skates toward the pathway for clamping of the length of the continuous string between the gripping faces and rolling movement of the endless chains over the spherical balls exposed on the side of the skate that faces toward the pathway;

wherein the spherical balls of each skate are exposed on the upright side of said skate through a gap at said upright side that measures less than a diameter of said spherical balls to prevent exit of said spherical balls from said upright side of the skate.

According to a second aspect of the invention there is provided a skate for applying a clamping pressure to a continuous string during injection or withdrawal of the continuous string into or from a wellbore using an apparatus in which gripper dies on a pair of endless chains driven around respective closed loop paths on different sides of an upright length of the continuous string are forced against the length of the continuous string by forcing a set of skates toward the length of the continuous string from inside the closed loop paths of the endless chains, the skate comprising a skate body carrying a plurality of spherical balls that are exposed through a gap of lesser size than a diameter of said spherical balls on a side of the skate arranged to stand upright and face toward the length of the continuous string to allow riding of endless chains over exposed surfaces of the spherical balls as the endless chains are driven through the respective closed-loop paths, whereby the gripper dies ride over the spherical balls of said skates under the forcing of said skates toward the length of the continuous string.

In either of the forgoing aspects of the present invention, preferably each skate comprises at least one endless raceway in which the spherical balls are rollingly disposed for recirculating movement of the spherical balls around said raceway.

In either of the forgoing aspects of the present invention, preferably each skate comprises two raceways each containing a respective set of spherical balls.

Preferably the base surface of each gripping die comprises a pair of parallel grooves each arranged to respectively ride over the sets of spherical balls in the two raceways.

Each skate may comprise two skate body members each having a respective one of the two raceways recessed into the skate body from an inner face thereof, the two skate body members being attached together with their inner faces facing toward one another.

A separator wall may be sandwiched between the two skates body members of each skate at the inner faces of said skate bodies to divide the two raceways from one another.

In either of the forgoing aspects of the present invention, preferably the at least one raceway comprises a recessed raceway that is at least partially defined by a recessed area of a skate body member.

The recessed raceway may be partially covered by a plate at a face of the skate body member from which the recessed area is recessed into said skate body.

There may be provided a second recessed raceway that comprises a second recessed area of a second skate body member disposed on an opposing side of the plate.

In either of the forgoing aspects of the present invention, the at least one endless raceway may comprise at least one cooperatively defined raceway formed by aligned and communicating recesses respectively defined in mated together faces of a pair of adjacent skate body members.

According to a third aspect of the invention there is provided a method of manufacturing a skate for applying a clamping pressure to a continuous string during injection or withdrawal of the continuous string into or from a wellbore using an apparatus in which gripper dies on a pair of endless chains driven around respective closed loop paths on different sides of an upright length of the continuous string are forced together against the length of the continuous string by forcing two skates toward the length of the continuous string from inside the closed loop paths of the endless chains, the method comprising providing a skate body and supporting a plurality of spherical balls on the skate body in a manner exposing surfaces of said spherical balls through a gap of lesser size than a diameter of said spherical balls at a side of the skate intended to stand upright and face toward the length of the continuous string during use of the apparatus such that the endless chains ride over the exposed surfaces of the spherical balls as the endless chains are driven through the respective closed-loop paths.

Preferably the method includes forming at least one endless raceway in the skate body and installing the spherical balls within said raceway to enable recirculation of said balls around said raceway during use of the skate.

The method may include recessing the one endless raceway into a face of a skate body member, installing the spherical balls into said raceway, and then at least partially closing off the raceway at said face of the skate body member to secure the spherical balls within the raceway.

The step of at least partially closing off the raceway at said face of the skate body member may comprise assembling a plate to said skate body member at said face thereof.

The method may include recessing two endless raceways in the skate body by recessing each of said two endless raceways in the face of a respective skate body member, and assembling the two skate body members together with the faces of the skate body members facing toward one another.

The method may include sandwiching a separator wall between two faces of the skate body members during assembly thereof to divide the two endless raceways from one another.

The method may include forming two recesses in respective faces a pair of skate bodies, placing at least some of spherical balls in one of said two recesses, and assembly the pair of skate bodies together face-to-face with the two recesses in alignment and communication with one another to cooperatively form a raceway in which said at least some of the spherical balls are disposed.

BRIEF DESCRIPTION OF THE DRAWINGS

In the accompanying drawings, which illustrate one or more exemplary embodiments of the present invention:

FIG. 2A is an exploded elevational view of a two-race recirculating-ball type skate of the present invention from a side thereof that faces toward the continuous coiled tubing or rod in FIG. 1, with one of the gripping dies from the respective conveyor chain shown for reference.

FIG. 2B is an exploded overhead view of the recirculating-ball type skate and gripping die of FIG. 2A.

FIG. 2C is an exploded perspective view of the recirculating-ball skate and gripping die of FIG. 2A.

FIG. 2D is another exploded perspective view of the recirculating-ball skate and gripping die of FIG. 2A.

DETAILED DESCRIPTION

Figure 1:
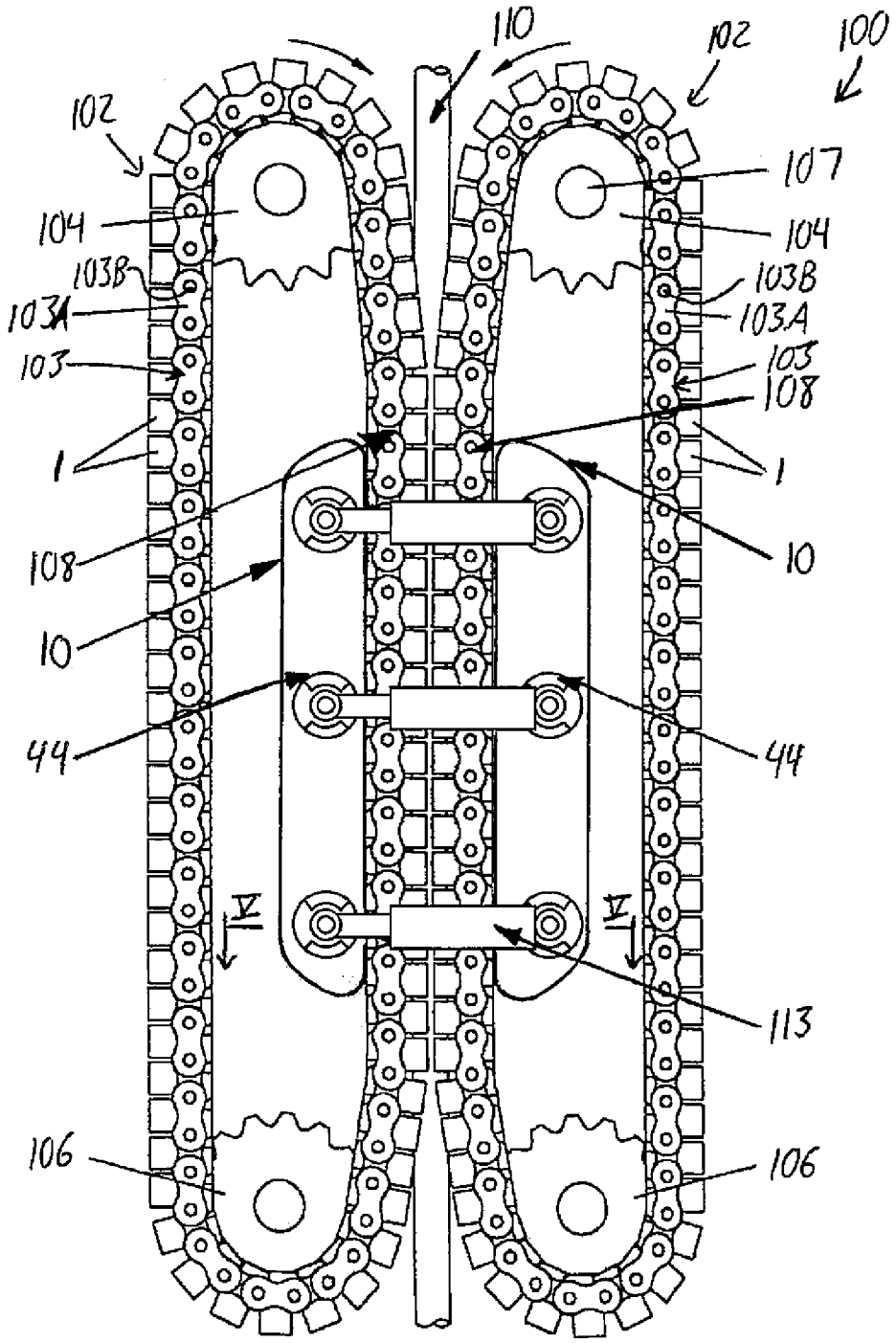
FIG. 1 is a schematic elevational view of an injection head employing a recirculating-ball type skates of the present invention to apply pressure for gripping a length of continuous coiled rod or tubing between gripping dies of counter-rotating conveyor chains.

FIG. 1 schematically illustrates the general layout of an injector head 100 of a known type operable to convey lengths of continuous rod or tubing into and out of a well. The injector 100 comprises a frame that supports two continuous, endless conveyor chain assemblies 102 thereon for rotation of the two chain assemblies in counter-rotating directions within a common vertical plane. Each of the chain assemblies features at least one chain 103 entrained about at least an upper sprocket 104 and a lower sprocket 106, one of which is driven for rotation by the drive shaft 107 of a suitable drive source (not shown), and the other of which may be an idler sprocket arranged to take up the slack in the chain. The path of each of the chain assemblies 102 includes an inner vertical run 108 such that the two vertical runs of the chain assemblies run parallel to one another in relatively close proximity with one another on opposite sides of a small space left between them. This space forms a longitudinal path arranged to receive the continuous coiled rod or tubing 110 for displacement thereof with the chains in the longitudinal direction of the rod and the vertical runs 108.

Each chain assembly 102 is completed by a plurality of gripper dies 1 of identical configuration that are coupled to the chain(s) 103 of the assembly so that the gripper dies rotate with the chain about the sprockets 104, 106 so that gripping faces of opposing gripper dies 1 of the two chain assemblies face toward one another along the vertical runs of the conveyor chains in order to grip opposing sides of the continuous rod 110 received therebetween.

In order to apply a gripping pressure to clamp or grip the coil tubing or continuous rod 110 between the opposed vertical runs of the chain assemblies, each of the vertical runs of the chain assemblies is accompanied by a skate 10 that resides adjacent the vertical run 108 of the chain assembly 102 just inside of the closed-loop path followed by the chain assembly under driven rotation of the drive sprocket 107. In a conventional manner, the purpose of the skates is to apply pressure to the gripping dies 1 of the chain assemblies 102 on the interior sides thereof opposite the continuous rod or tubing 110 disposed between the chain assemblies. When the opposed skates 10 of the two conveyor chain assemblies are urged towards one another by hydraulic actuators 113 coupled between them, the gripper dies 1 on opposing sides of the rod or tubing 110 are forced toward one another, and thereby tightened against the respective sides of the continuous rod or tubing 110.

It is in the design of the skates and the gripping dies cooperable therewith that the present invention is distinct from prior art injector heads. Conventional injector head skates include cylindrical rollers that are either rotatably supported on a body of the skate, or defined as part of a roller chain entrained around a pair of sprockets rotatably carried on the skate body, and the base end of each gripper die facing away from the rod or tubing 110 as the gripper moves along the vertical run of the conveyor chain's closed-loop path rides over the cylindrical rollers to reduce friction of the drive chain assemblies sliding along the skates in the longitudinal direction. As described in more detail further below, the present invention breaks from this convention, and instead uses spherical balls in place of cylindrical rollers in order to further reduce friction of the gripper dies as they move over the skates.

FIG. 2 features exploded views illustrating the makeup and assembly of a skate 10 of the present invention. A body of the skate 10 is substantially formed by assembly of two body members 12, 14, in each of which there is formed a respective raceway 16 in which a respective set of spherical balls 17 are rollingly disposed adjacent one another in a series that substantially fills the closed-loop length of the raceway. The raceway 16 of each body member 12, 14 is recessed into the body member at an inner face 18 thereof that faces toward the inner face of the other body member when the two are assembled together.

Each body member 12, 14 has an elongated beam- or bar-like shape, a length L and width W of which are measured perpendicularly to one another in the plane of the inner face 18, and a thickness T of which is measured perpendicularly to the plane of the inner face. The length L is the greatest dimension of the body member, followed by the width W, which in turn is greater than the remaining thickness dimension T. The raceway 16 is recessed into the body member from the inner face 18 thereof and outlines an endless closed-loop path that follows along a perimeter of the body member. This raceway path features two parallel legs 16*a*, 16*b* spanning linearly along respective lengthwise peripheral sides 20, 22 of the body member, and two arcuate spans 16*c*, 16*d* that each span 180-degrees to join the two parallel legs 16*a*, 16*b* together adjacent a respective widthwise end 25*a*, 25*b* of the body member. A depth of the raceway measured perpendicularly to the inner face of the body member (i.e. measured in the thickness direction T of the body member) is uniform around the raceway path.

The raceway 16 of the illustrated embodiment overlaps with or opens through the first lengthwise peripheral side 20 of the body member over the full length of the first linear leg 16*a* of the raceway, and over a partial length of each arcuate span 16*c*, 16*d*, particularly where these arcuate spans join up with the first linear leg 16*a*. In other words, a portion of the body member's thickness T at the first peripheral side 20 is cut away by the machining of the raceway into the inner face of the body member, giving the first peripheral side 20 a reduced thickness compared to a remainder of the body member's periphery.

Figure 4:
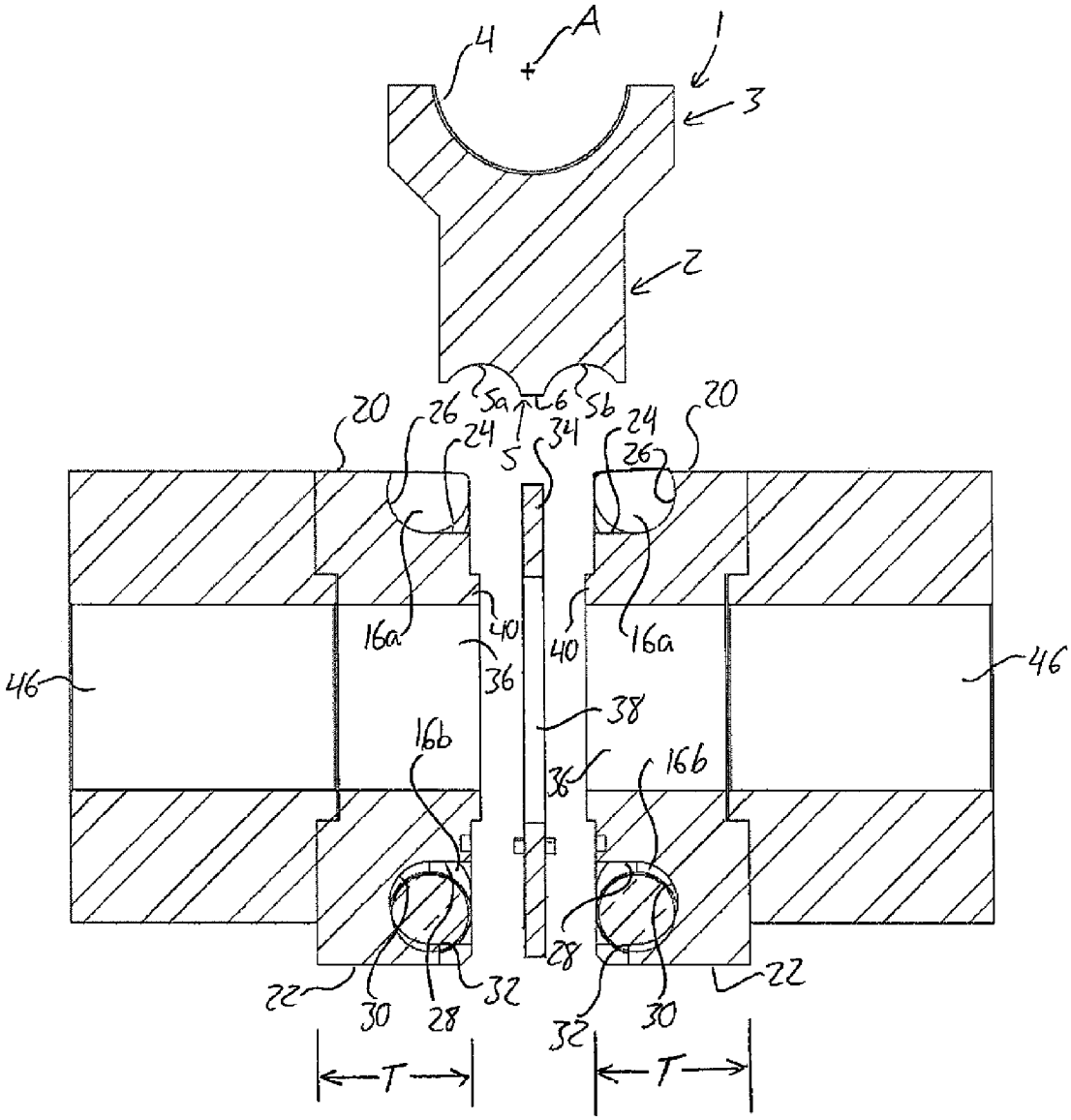
FIG. 4 is a cross-sectional view of the skate of FIG. 3 in a partially exploded state with some of the recirculating spherical balls removed therefrom for to better illustrate features of a pair of raceways in which the balls are installed.

Referring to FIG. 4, the cross-sectional shape of the first leg 16*a* of the raceway is generally j-shaped, with a flat side wall 24 of the raceway's first leg jutting into the body member in the thickness direction T from the inner face 18 An arcuate bottom 26 of the raceway's first leg curves smoothly from and end of the flat side wall 24 opposite the inner face 18, and spans more than 90-degrees, but less than 180-degrees, to an intersection with the first peripheral side 20 of the body member.

The cross-sectional shape of the second leg 16*b* of the raceway is generally J-shaped, with a flat side wall 28 of the raceway's second leg jutting into the body member in the thickness direction T from the inner face 18 like the flat side wall of the first leg. However, an arcuate bottom 30 of the raceway's second leg spans a full 180-degree arc from the end of the flat side wall 28 opposite the inner face 18, and ends at a location inward from the second peripheral side 22 of the body member, instead of intersecting therewith. In the illustrated embodiment, a small portion of the second peripheral side 22 is cut away from the inner face 18 over the length of the second linear leg 16*b* of the raceway 16, as shown at 32, thus giving the second leg its J-shape instead of a U-shape where both of its side walls reach fully to the inner face 18 of the body member.

One method of assembling a skate of the illustrated embodiment is described as follows. With referring to FIG. 2C, one of the skate bodies 12 is laid inner-face up and its raceway 16 is filled with a respective set of identical spherical balls 17. The ball radius is only slightly smaller than the radius of curvature of the arcuate raceway bottom, whereby each ball closely conforms to the bottom of the raceway channel to avoid notable lateral play of the ball inside the raceway, while being freely rollable along the raceway path. A flat plate 34 of same or similar peripheral shape to each of the two skate bodies is placed overtop the upward-facing inner face 18 of the laid down, ball-filled skate body member 12, and fastened in this position overlying the inner face of the ball-filled skate body member 12. This, thereby closes off the top of the raceway in the ball-filled skate body member 12 over the full raceway path, whereby the balls are safely secured within the raceway, but freely rollable therein.

The second set of spherical balls is likewise inserted into the raceway of the second body member 14 while positioned inner face up, at which the point the already-fastened together first body member and flat plate 34 can be laid atop the inner face of the second body member 14, thereby sandwiching the flat plate 34 between the two bodies. The second body member 14 is fastened to the plate 34 and first body member 12, whereby the balls in the raceway of the second body member are now secured therein, yet freely rollable therealong. As shown in cross-sectional view of FIG. 3, the flat plate 34 sandwiched between the two skate body members forms a separator wall separating the raceways of the two body members 12, 14 from one another.

Each skate body member 12, 14 has a plurality of large through-holes 36, of which there are three in the illustrated embodiment. These large hole 36 are spaced apart in the lengthwise dimension L of the skate body member and pass therethrough along the thickness dimension T thereof. The flat plate 34 has a matching set of through-holes, as shown at 38. The large through-holes 36 in the skate body members are located in a central core area thereof, around which the raceway 16 extends. Each large hole 36 in each skate body member 12, 14 lines up with a matching one of the large holes in the other skate body member and a matching one of the large holes 38 in the flat plate 34 when the body members and plate are assembled. Each large through-hole 36 in each body member may have an annular boss 40 that surrounds the through-hole and projects slightly from the otherwise planar inner face 18 from which the raceway 16 is recessed. The annular bosses 40 of a pair of matching large through-holes 36 in the two body members 12, 14 each reach into the matching large through hole 38 of the flat plate 34, where the bosses 40 abut face to face inside the plate's hole 38, and positively locate the two body members and plate in alignment with one another.

Smaller bolt holes 42 may also extend through each skate body member and the flat plate 34 for use in fastening these components together with bolts once mated together in alignment with one another. The bolt holes may include or consist of bolt holes located adjacent the larger through-holes for fastening of reinforcement collars 44 to an outer face of each skate body member in positions placing through-bores 46 of these collars 44 in alignment with the large through-holes 36, 38 of the skate body members and the flat plate 24.

Figure 3:
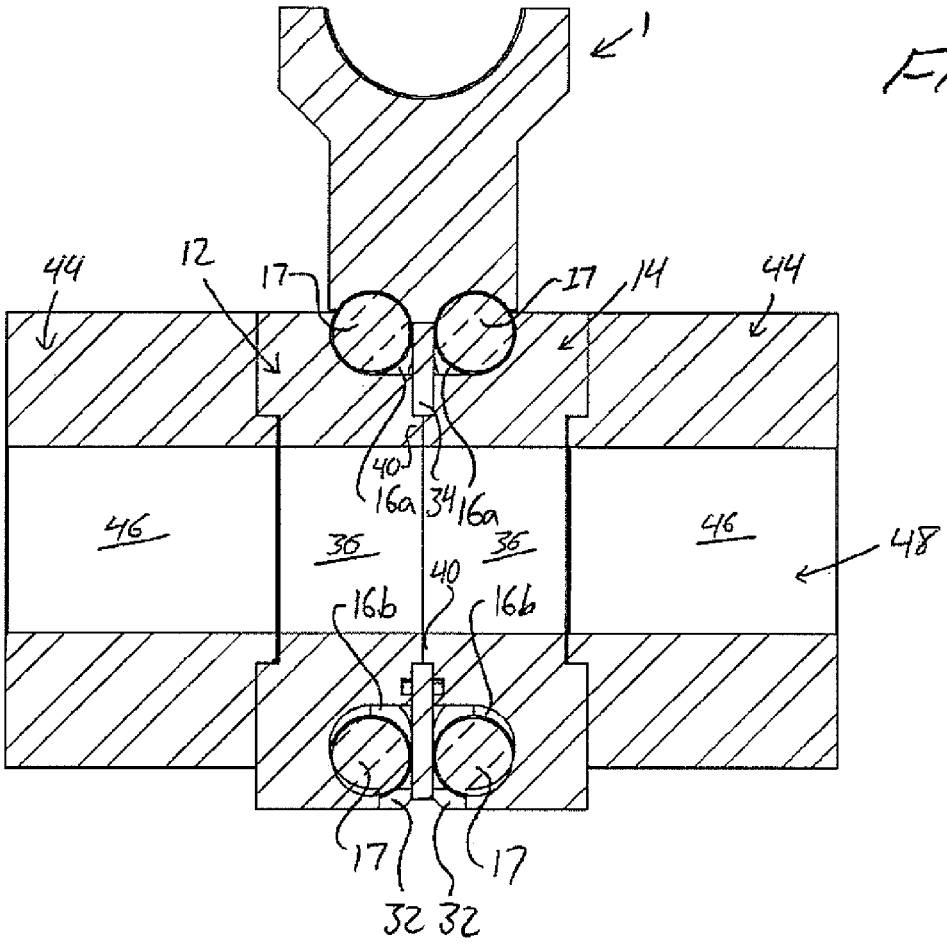
FIG. 3 is a cross-sectional view of an assembled skate of the type shown in FIG. 2A as viewed along line III-III thereof.
Figure 5:
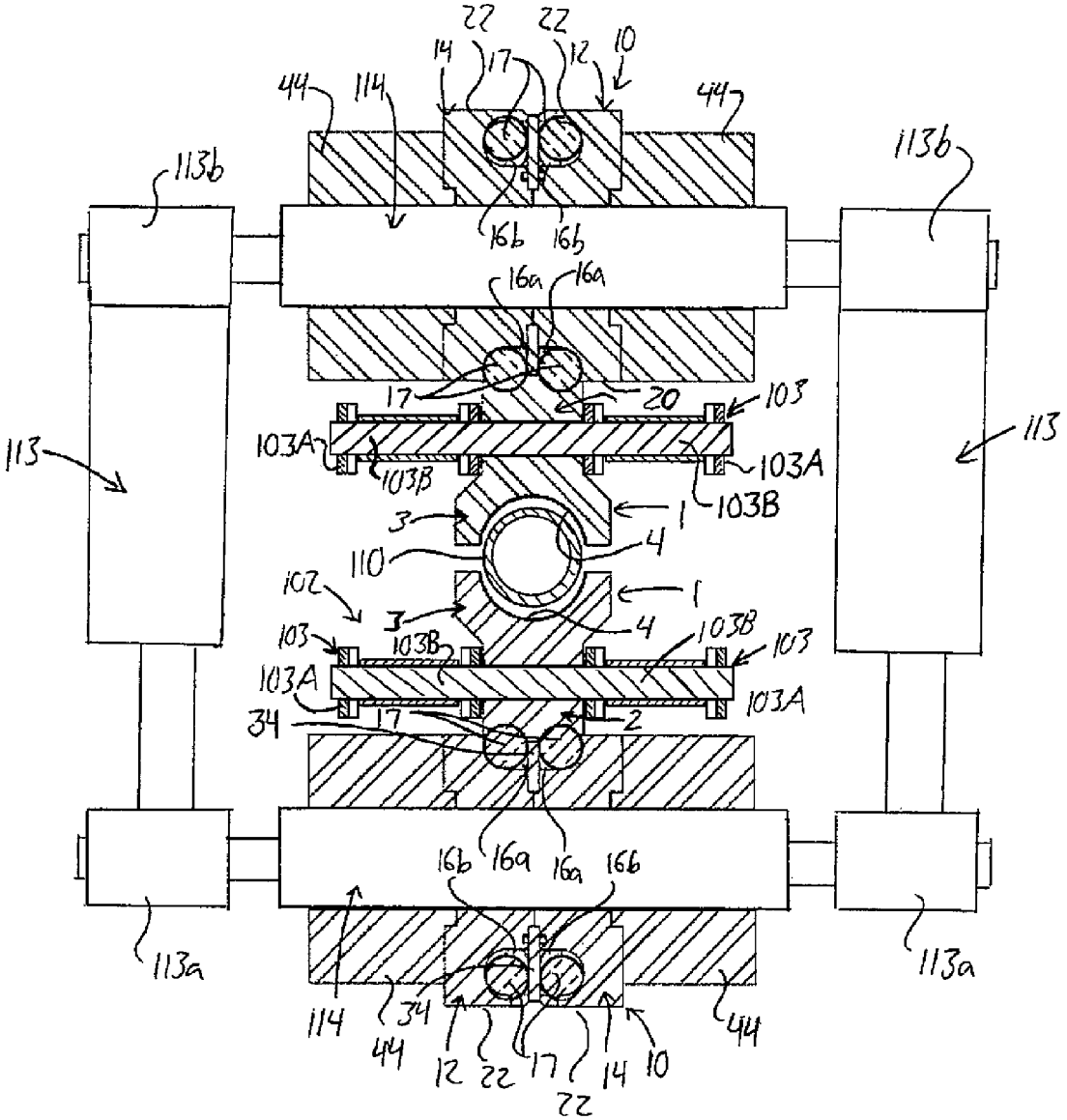
FIG. 5 is a cross-sectional view of the injection head of FIG. 1 with the skates and conveyor chains cut away along line V-V thereof.

With reference to FIG. 3, each set of the aligned body hole 36, plate hole 38 and collar bore 46 forms a respective through tunnel 48 in the resulting assembly in which a shaft or trunnion 114 can be installed to pass through this tunnel 48, as shown in FIG. 5. As with conventional injector heads, at each end of the shaft or trunnion 114, one end (e.g. the piston rod end 113*a*) of a respective hydraulic actuator 113 is attached to the shaft or trunnion, and the other end (e.g. the cylinder end 113*b*) of the respective hydraulic actuator 113 is attached to the matching end of another shaft or trunnion 114 likewise installed at a matching-elevation through-tunnel 48 of the other skate 10 of the injector head. The skates are thus forced together and apart in the same manner as conventional injector heads by retraction and extension of the hydraulic actuators between the two skates 10.

Referring to FIG. 4, each gripping die 1 features a base portion 2 that forms the part of the die that is configured for connection within the conveyor chain links 103A of the injection head. With reference to FIG. 5, this connection may be accomplished in a conventional manner by passing of the link-connecting pins 103B of the chain 103 through transverse holes in the base portion 2 of the gripping die 1. A gripping portion 3 of each die 1 forms the interface for engagement against the coil tubing or continuous rod. The gripping portion 3 defines a gripping face 4 that is suitably shaped or contoured to grip against the circumferential periphery of the tubing or rod 110. Examples of different profiles for gripping round tubing or round and/or elliptical rod are known, including V-shaped profiles with linearly sloped walls, arcuate profiles, and combinations thereof (i.e. arcuate center with linearly walls sloping laterally outward therefrom). The gripping die of the present invention may use any known profile at this gripping face that faces toward the tubing or rod as the gripping dies moves through the vertical run of the respective conveyor chain adjacent the longitudinal channel in which the tubing or rod is inserted. Where the gripping die 1 deviates from prior gripping die designs is in the base surface 5 that lies opposite the gripping face 4 at the end of the base portion 2 furthest therefrom and faces toward the skate 10 during movement through the vertical run of the conveyor chain assembly.

In the prior art, where the skates use cylindrical rollers, this base surface has typically been flat, or at least included flattened areas that ride on the peripheries of the cylindrical rollers. However, in the present invention, where the skates 10 use spherical balls instead of cylindrical rollers as the roller elements of the skate, the base surface 5 of the gripping die instead features two grooves 5*a*, 5*b* running longitudinally of the die (i.e. in a direction parallel to an axis A around which the gripping face profile is contoured). Each groove 5*a*, 5*b* is arcuately contoured about a respective longitudinal axis lying parallel to axis A. The radius of curvature of each arcuate groove equals or slightly exceeds the radius of the spherical balls 17. Between the two arcuately recessed or grooved areas of the base surface 5, a flat planar area 6 defines a furthest extent of the base surface 5 from the gripping face 4. A width of the flat planar area measured between the two arcuate grooves 5*a*, 5*b* in a direction perpendicular to the parallel axes of these grooves slightly exceeds a thickness of the flat plate 34.

Referring to FIG. 1, each skate 10 is installed on the injector head frame in a position placing the length dimension L of the skate body vertically upright at a location adjacent the vertical run 108 of the respective conveyor chain assembly 102, with the first lengthwise peripheral sides 20 of the assembled skate body members facing toward the vertical run 108 of the conveyor chain assembly 102. The first lengthwise sides of each assembled skate body thus faces toward the longitudinal path between the two vertical runs of the conveyor chain assemblies so as to face toward the tubing or rod 110 when received in the longitudinal path.

FIG. 5 shows a cross-sectional view of the injector head of FIG. 1, in which the skates and conveyor chain have been cut away along line V-V. As shown, each ball 17 in the raceway of each skate body member projects partially out from the skate body at the first lengthwise side 20 thereof when the ball is positioned within the first leg 16*a* of the raceway 16. At any given movement, a smaller—than-hemispherical frusto-spherical portion of the ball 17 thus projects outwardly past this lengthwise side 20 of the body member toward the longitudinal path between the adjacent vertical runs 108 of the conveyor chain assemblies to present an exposed spherically contoured surface outside the skate body. The assembled skate body and the respective conveyor chain assembly are aligned such that each of the two arcuate grooves 5*a*, 5*b* in the base surface 5 of each gripper die 1 aligns with raceway 16 of a respective one of the skate body members 12, 14, and the flat area 6 of the gripper die base surface 5 between the two grooves aligns with the flat plate 34 between the two body members 12, 14.

Accordingly, as the hydraulic actuators 113 are retracted to pull the two skates 10 toward one another, and thus also pulling them toward the tubing or rod 110 between them, the balls 17 that project forwardly from the first sides 20 of the skate bodies are forced against the base surface 5 of the gripper dies at the vertical runs of the conveyor chains. More particularly, at each skate 10, the exposed surfaces of the spherical balls 17 in the first leg 16*a* of the raceway 16 of each skate body member 12, 14 are forced against the base surfaces 5 of each such gripper die 1 within a respective one of the arcuate grooves 5*a*, 5*b* therein. Under sufficient retraction of the actuators 113, the gripping faces 4 of the gripping dies 1 at the vertical runs of the conveyor chains abut against the periphery of the tubing or rod 110. The driven movement of the chains acts to convey the gripped length of the tubing or rod 110 through the longitudinal pathway along the vertical runs 108 of the chain assemblies 102. During this movement, the spherical balls provide a low friction rolling interface between the gripper dies of the chain assembly and the skate bodies. The movement of the gripper dies over the balls at the first leg of each raceway causes the balls to roll onwardly through the raceway, causing all the balls in the raceway to recirculate around the raceway under continued driven movement of the chain assembly.

Referring to FIG. 3, despite projecting from the first leg 16*a* of its raceway at the first peripheral side of its skate body member, each rigid spherical ball 17 is prevented from exiting its raceway through this open side of the first leg 16*a* by cooperation of the j-shape of this raceway leg with the flat plate 34. The more than 90-degree span of the arcuate bottom of the raceway's j-shape at this leg 16*a* causes it to curve slightly back toward the inner face 18 of the skate body member at which the flat plate 34 is mounted, and the length of the linear side wall 24 of this leg 16*a* of the raceway from the inner face 18 of the body member to the arcuate bottom wall of the leg only slightly exceeds the ball radius. As a result, the raceway's maximum depth from the end face 18 is only slightly greater than the ball diameter, and the j-shape of the raceway at this raceway leg 16*a* hooks sufficiently far around the ball 17 from the flat plate 34 so that the gap measured from the point of intersection between the arcuate bottom of the raceway and the peripheral side 20 of the skate body member to the nearest corner of the corresponding peripheral edge of the flat plate 34 is less than the ball diameter.

Figure 6A:
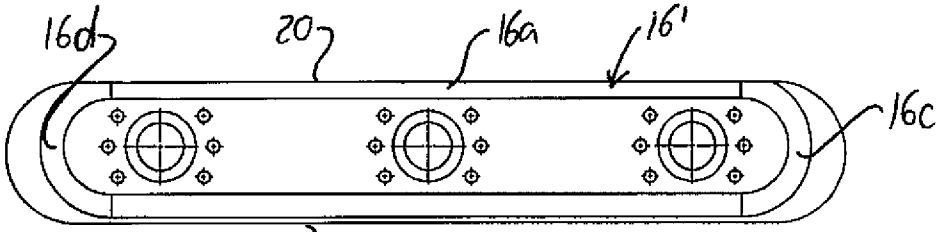
FIGS. 6A, 6B and 6C show various views of a slight variant of the two-race skate design of the preceding figures.
Figure 6B:
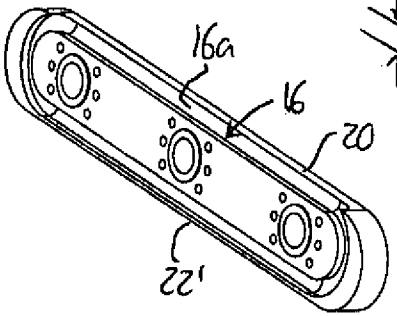
Figure 6C:
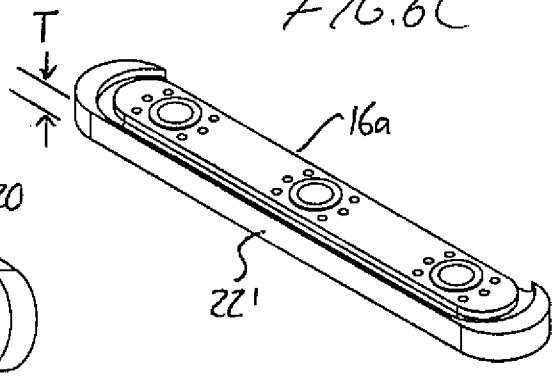

FIG. 6 shows a slight variant of the forgoing skate body member design, where the second linear leg of the raceway 16' has a U-shaped cross-section with a full 180-degree arcuate bottom, just like the two arcuate end spans 16*c*, 16*d* of the raceway. In this embodiment, only the first linear leg 16*a* of the raceway 16' and the ends of the arcuate spans 16*c*, 16*d* joining therewith are open to the periphery of the skate body member, with the entire remainder of the raceway 16' being closed to the outside environment. This is perhaps best illustrated in FIG. 6C, where the second peripheral side 22' of the skate body member can be seen to span the full thickness T of the skate body member.

In comparison, the cutout 32 skate in the second side of each skate body member of FIGS. 1 to 5 truncates the second leg of the skate into its J-shaped form, and leaves an opening into the second leg of the raceway when the skate is assembled, as shown in FIG. 3. This may be beneficial, for example to ease any required cleaning out of the raceway without full disassembly of the skate.

In another embodiment (not shown), the first and second legs of the raceway may be identical, whereby the balls project outward from the skate body periphery at both the first and second legs, which may be useful to allow riding of an outer vertical run of each conveyor chain along the second side of the skate, or to allow installation of the skate in either one of two possible orientations (i.e. with either the first or second peripheral side facing the inner vertical run 108 of the conveyor chain).

The use of two races 16 at each skate 10 with two respective sets of spherical balls 17 contacting each gripper die 1 within respective grooves 5*a*, 5*b* helps maintain alignment of the gripper dies 1, as the conforming fit of each arcuate groove 5*a*, 5*b* over the balls 17 of the two races 16 prevents the gripper die from tilting about a vertical axis parallel to the first raceway legs 16*a* and the intended longitudinal path of the tubing or rod 110. Accordingly, a twisting action of the conveyor chain assembly is prevented, or at least resisted. It may be possible have embodiments with only a single raceway and single respective set of balls if some other mechanism is employed to maintain the proper orientation of the gripper dies and chain. However, the use of two more races of balls achieves this result with minimal friction at the interface with the moving gripper dies.

Although the describe recessing of the raceways into facing together inner faces of two skate body members allows use of a single plate to cover off both of the raceway's of the skate, other ways of creating a pair of raceways for containing respective sets of recirculating balls may alternatively be employed. As mentioned above, the number of raceways (and respective sets of balls) in the assembled skate body may be varied.

Figure 7A:
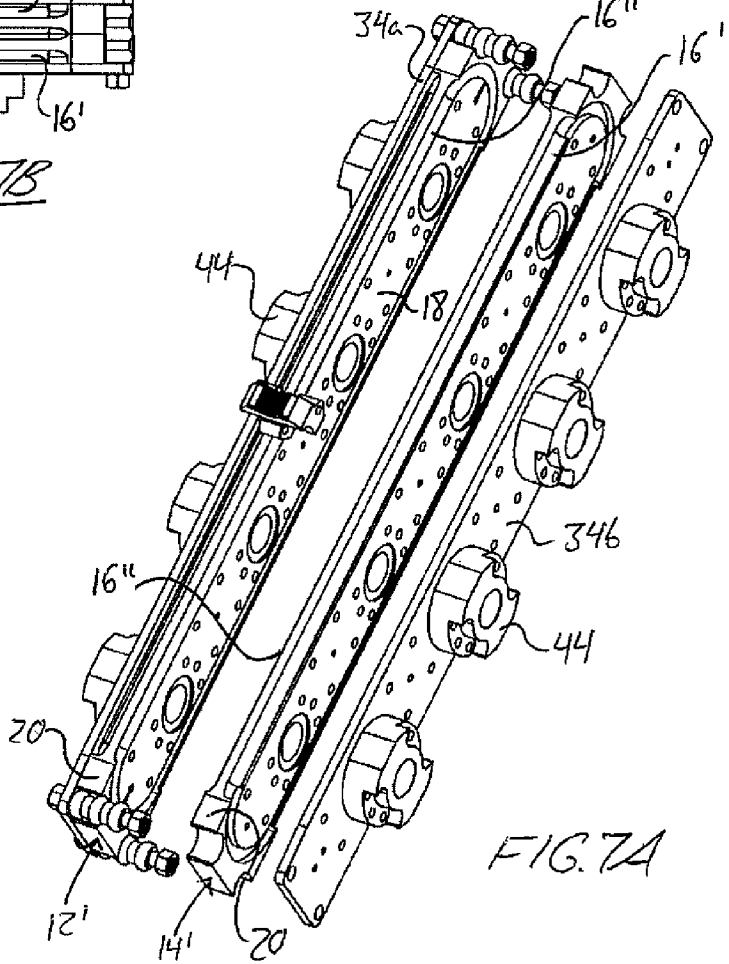
FIG. 7A is an exploded perspective view of a three-race recirculating-ball skate of the present invention, with one of the gripping dies from the respective conveyor chain shown for reference.
Figure 7B:
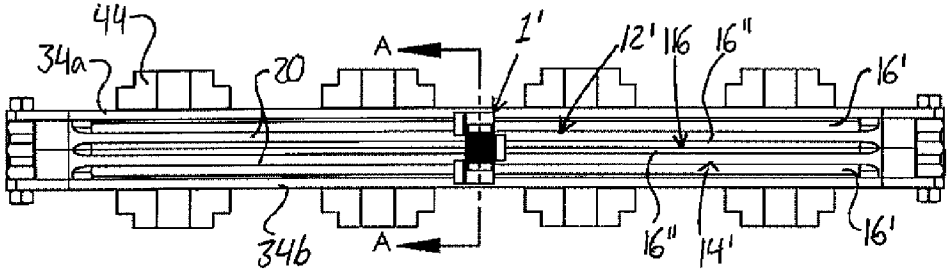
FIG. 7B is an assembled planar view of the recirculating-ball skate of FIG. 7A from the side thereof that faces toward the continuous coiled tubing or rod in FIG. 1.

For example, FIG. 7 shows another embodiment in which the assembled skate body features three raceways for holding three respective sets of spherical balls (not shown). Where the preceding embodiments employ two skate body members with a separator plate disposed centrally therebetween, the FIG. 7 embodiment employs two skate body members 12', 14' and a pair of outer cover plates 34*a*, 34*b* mounted thereto at the outer faces thereof.

Each body member features two recesses therein, a first one of which defines a respective raceway 16' of similar form to the raceway 16 of FIGS. 1 to 5, but in the outer face of the body member that faces away from the other skate body member, instead of in the inner face 18 of the skate body member that faces toward the other skate body member. The illustrated raceway 16' also differs slightly from the preceding embodiments in that it has a convex curvature over part of its side wall 24' at the first linear leg 16*a* of the raceway. This side wall curvature forms a continuous arcuate extension of the acruate bottom 26 of the raceway 16' in order to better conform to the spherical shape of the balls that are to be received in the raceway 16'. A respective one of the cover plates 34*a*, 34*b* is fastened to the outer face of each body member 12', 14' in order to close off the top of the raceway 16' and secure the respective set of balls therein, thus operating in the same manner as the separator plate 34 of the preceding embodiments, but for only a single respective race of the skate. In this embodiment where the cover plates 34*a*, 34*b* conceal the outer faces of the skate body members 12', 14', the reinforcement collars 44 are provided on the outer sides of the cover plates that face externally away from the skate body members 12', 14', rather than on the skate body members themselves.

The second recess 16" of each skate body member 12', 14' is defined in the inner face 18 thereof and is of purely arcuate form. In the first linear leg 16*a* of the second recess 16" extending along the first peripheral side 20 of the skate body, the arcuate form of the second recess 16" spans more than 90-degrees but less than 180-degrees from the inner face 18 of the skate body member to the first peripheral side 20 thereof. In its second linear leg 16*b* extending along the second peripheral side 22 of the skate body, the second recess 16" is spaced inwardly from second peripheral side 22 of the skate body member and spans more than 90-degrees, and closer to 180-degrees, toward the peripheral side 22 from where the recess 16" cuts into the inner face 18. A cutaway 32 like that of the skates in FIGS. 1 through 5 communicates with the second leg 16*b* of the second recess 16".

Figure 7C:
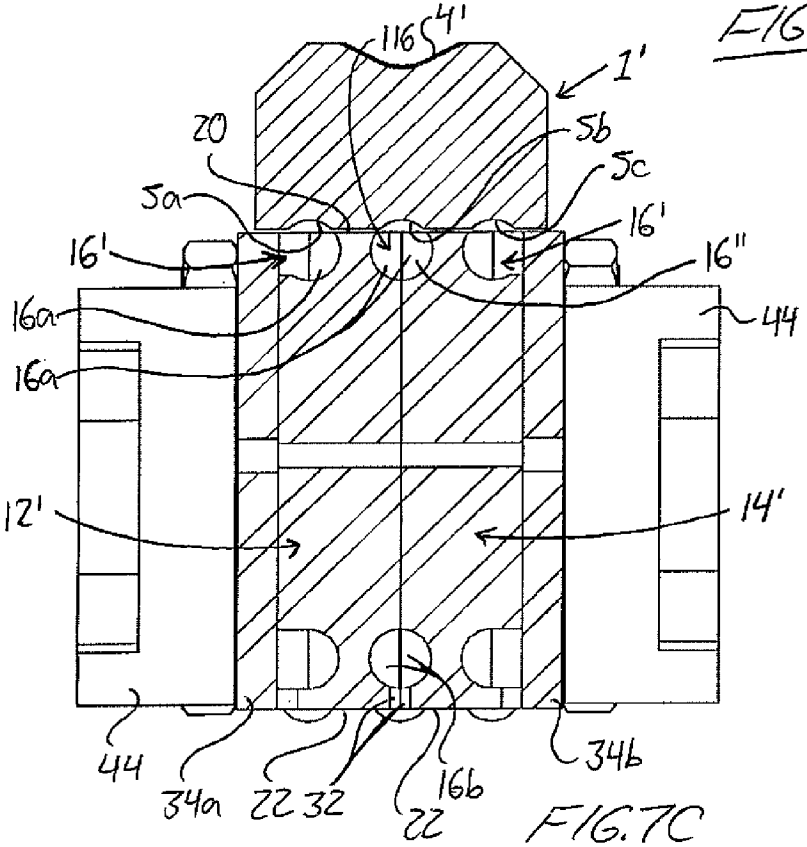
FIG. 7C is a cross-sectional view of the recirculating-ball skate of FIG. 7B, as taken along line A-A thereof.

As shown in FIG. 7C, the two skate body members 12', 14' are fitted together with their inner faces 18 mated flush with one another, whereby the symmetrically matching second recesses 16" of the two skate body members 12', 14' align and openly communicate with one another at the mated-together inner faces in order to cooperatively form a central raceway 116 that is disposed centrally between the two outer raceways 16' at the outer faces of the skate body members 12', 14'. The gripper die 1' in FIG. 7 thus features not two, but rather three, arcuately contoured longitudinal grooves 5*a*, 5*b*, 5*c* in the base surface of the gripper die to overlie the three sets of spherical balls in the three raceways. The gripper die 1' of FIG. 7 features a differently profiled gripping face 4' than that of FIGS. 2 to 6, from which it will be appreciated that the present invention may be used with any of a variety of gripping dies of various shape and construction.

The embodiment of FIG. 7 shows how aligned partial-raceway recesses 16" in mating skate body members may cooperatively form a single respective raceway 116, whether in addition to, or as an alternative to, formation of another raceway between a single recess in one member and a flat plate attached to that member.

Figure 8:
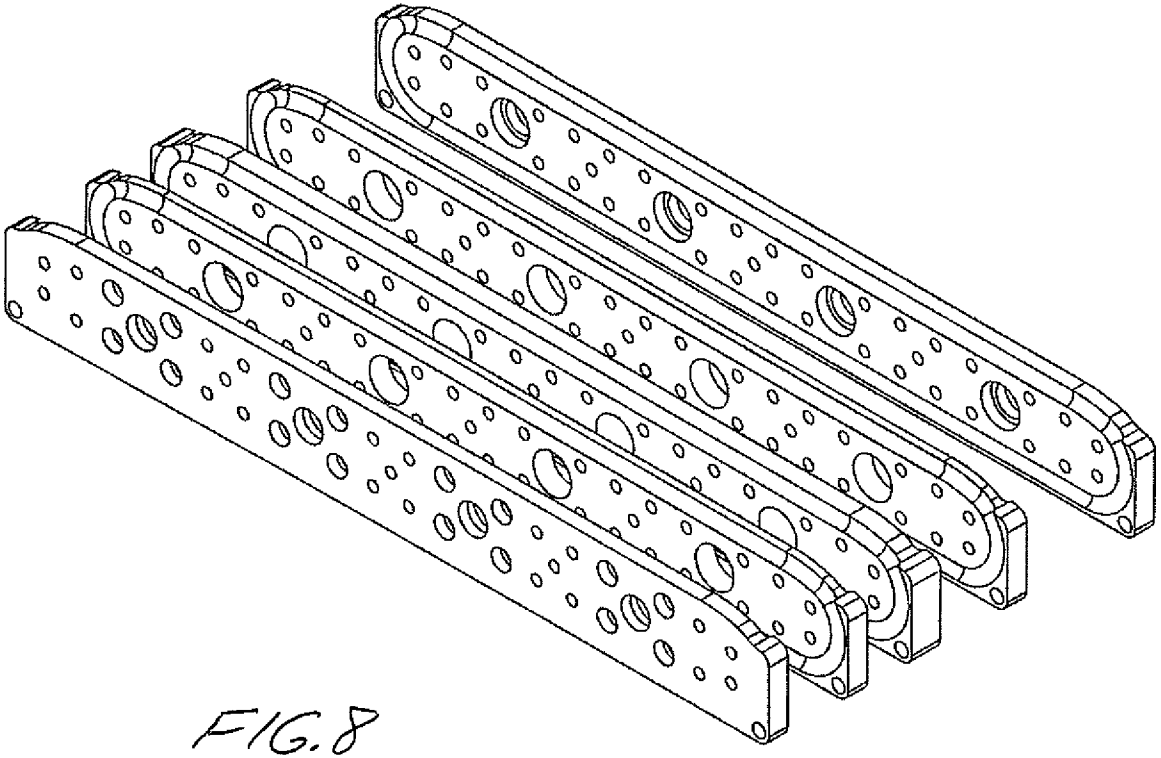
FIG. 8 is an exploded perspective view of a five-member skate body construction for a four-race recirculating-ball skate of the present invention.

This is further demonstrated with reference to FIG. 8, in which there is illustrated another skate construction that employs five recess-equipped skate body members, the outer two of which feature each feature a half-race recess on only the inner face, and the inner three of which each feature two such half-race recesses, one at each face of the skate member. This arrangement defines four raceways, each defined by a pair of cooperating recesses in two mated-together skate members.

Skates using spherical roller elements as described herein may be used in different types of injectors for injecting a continuous string into a wellbore regardless of the type of string (e.g. continuous rod, coiled tubing, etc.). For example, the skates may be used with gripper dies configured for use with coiled tubing in a coiled tubing injector, or with gripper dies configured for use with continuous rod (round and/or elliptical) in a continuous rod injector. While arrows in FIG. 1 illustrate revolution of the two conveyor chain assemblies in a direction causing downward movement at the vertical runs 108 to inject the continuous rod or tubing 110 downward into a wellbore, it will be appreciated that the conveyor chain directions can be reversed to instead lift the tubing or rod for withdrawal of same from the wellbore, as is typical in conventional rod or tubing injectors.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An apparatus for injecting or withdrawing a continuous string into and from a wellbore, the apparatus comprising:

a plurality of endless drive conveyors positioned on different respective sides of an upright pathway in which an upright length of the continuous string is receivable, each endless drive conveyor comprising an endless chain and a plurality of gripper dies coupled to the endless chain, each gripping die having a gripping face that faces outwardly from the endless chain and is shaped to engage a periphery of the continuous string and a base surface that faces inwardly from the endless chain, the endless chains being arranged for driven movement around respective closed-loop paths on the different sides of the upright pathway such that the gripper dies of each endless chain are conveyed in a same direction along the upright pathway at the respective side thereof during a portion of the respective closed-loop path;

a plurality of skates respectively residing on the different respective sides of the upright pathway with the closed-loop path of each endless chain closing around a respective one of the skates, each skate carrying a plurality of spherical balls that are exposed on an upright side of the skate that faces toward the pathway; and a force application mechanism operable to force the skates toward the upright pathway for clamping of the upright length of the continuous string between the gripping faces and rolling movement of the endless chains over the spherical balls exposed on the upright side of the skate that faces toward the pathway;

wherein the spherical balls of each skate are exposed on the upright side of said skate through one or more gaps at said upright side that each measure less than a diameter of said spherical balls to prevent exit of said spherical balls from said upright side of the skate.

2. The apparatus of claim 1 wherein each skate comprises two raceways each containing a different respective set of spherical balls exposed through a respective gap at the upright side of said skate.

3. The apparatus of claim 2 wherein the base surface of each gripping die comprises a pair of parallel grooves arranged to respectively ride over the sets of spherical balls in the two raceways.

4. The apparatus of claim 3 wherein the parallel grooves of the base surface of each gripping die are arcuately contoured.

5. The apparatus of claim 2 wherein each skate comprises two skate body members each having a respective one of the raceways recessed into the skate body from an inner face thereof, the two skate body members being attached together with their inner faces facing toward one another.

6. The apparatus of claim 5 comprising a separator wall sandwiched between the two skates body members of each skate at the inner faces of said skate bodies to divide the two raceways from one another.

7. The apparatus of claim 1 comprising at least one raceway in which the spherical balls are disposed, said at least one raceway comprising a recessed raceway that is at least partially defined by a recessed area of a skate body member, wherein the recessed raceway is partially covered by a plate at a face of the skate body member from which the recessed area is recessed into said skate body.

8. The apparatus of claim 7 comprising a second recessed raceway that comprises a second recessed area of a second skate body member disposed on an opposing side of the plate.

9. The apparatus of claim 1 comprising at least one raceway in which the spherical balls are disposed, wherein the at least one raceway comprises at least one cooperatively defined raceway formed by aligned and communicating recesses that are respectively defined in mated together faces of a pair of adjacent skate body members.

10. The apparatus of claim 1 comprising at least one raceway in which the spherical balls are disposed, said raceway having a cross-sectional shape with an arcuate curvature spanning more than 90, and less than 180, degrees.

11. A method of manufacturing a skate for applying a clamping pressure to a continuous string during injection or withdrawal of the continuous string into or from a wellbore using an apparatus in which gripper dies on a pair of endless chains driven around respective closed loop paths on different sides of an upright length of the continuous string are forced together against the upright length of the continuous string by forcing two skates toward the upright length of the continuous string from inside the closed loop paths of the endless chains, the method comprising providing a skate body and supporting a plurality of spherical balls on the skate body in a manner exposing surfaces of said spherical balls through one or more gaps of lesser size than a diameter of said spherical balls at a side of the skate intended to stand upright and face toward the upright length of the continuous string during use of the apparatus such that the endless chains ride over the exposed surfaces of the spherical balls as the endless chains are driven through the respective closed-loop paths.

12. The method of claim 11 comprising recessing a raceway into a face of a skate body member, installing a set of said spherical balls into said raceway, and then at least partially closing off the raceway at said face of the skate body member to secure the set of said spherical balls within the raceway while leaving a respective one of said one or more gaps open at a side of said raceway.

13. The method of claim 12 wherein the step of at least partially closing off the raceway at said face of the skate body member comprises assembling a plate to said skate body member at said face thereof.

14. The method of claim 11 comprising forming two raceways in the skate body by recessing each of said two raceways in the face of a respective skate body member, and assembling the two skate body members together with the faces of the skate body members facing toward one another with a different respective set of spherical balls received in each of said two raceways and exposed through a respective one of said gaps.

15. The method of claim 14 comprising sandwiching a separator wall between two faces of the skate body members during assembly thereof to divide and the two raceways from one another.

16. The method of claim 11 comprising respectively forming two recesses in respective faces of a pair of skate bodies, placing at least some of spherical balls in one of said two recesses, and mating the pair of skate bodies together face-to-face with the two recesses in alignment and communication with one another to cooperatively form a raceway in which said at least some of the spherical balls are disposed.

17. The method of claim 11 comprising forming at least one raceway in the skate body in a manner providing said raceway with an arcuate curvature spanning more than 90, and less than 180, degrees, and installing the spherical balls within said at least one raceway.

18. A skate for applying a clamping pressure to a continuous string during injection or withdrawal of the continuous string into or from a wellbore using an apparatus in which gripper dies on a pair of endless chains driven around respective closed loop paths on different sides of an upright length of the continuous string are forced against the upright length of the continuous string by forcing a set of skates toward the upright length of the continuous string from inside the closed loop paths of the endless chains, the skate comprising a skate body carrying a plurality of spherical balls that are exposed through a gap of lesser size than a diameter of said spherical balls on a side of the skate arranged to stand upright and face toward the upright length of the continuous string to allow riding of endless chains over exposed surfaces of the spherical balls as the endless chains are driven through the respective closed-loop paths, whereby the gripper dies ride over the spherical balls of said skates under the forcing of said skates toward the upright length of the continuous string.

19. The skate of claim 18 comprising at least one raceway in which the spherical balls are carried, said raceway having a cross-sectional shape with an arcuate curvature spanning more than 90, and less than 180, degrees.

* * * * *